US008365658B2

(12) United States Patent
Ouchi

(10) Patent No.: US 8,365,658 B2
(45) Date of Patent: Feb. 5, 2013

(54) METHOD FOR ORNAMENTING CONTAINER, ORNAMENTED CONTAINER MANUFACTURED BY THE METHOD, AND MANDREL, DRUM, AND ORNAMENTING APPARATUS USED FOR THE METHOD

(75) Inventor: Tadao Ouchi, Toyama (JP)

(73) Assignee: Takeuchi Press Industries Co., Ltd., Toyama-Shi, Toyama (JP)

( * ) Notice: Subject to any disclaimer, the term of this patent is extended or adjusted under 35 U.S.C. 154(b) by 958 days.

(21) Appl. No.: 12/305,841

(22) PCT Filed: May 8, 2008

(86) PCT No.: PCT/JP2008/058576

§ 371 (c)(1),
(2), (4) Date: Dec. 19, 2008

(87) PCT Pub. No.: WO2009/044569

PCT Pub. Date: Apr. 9, 2009

(65) Prior Publication Data

US 2010/0229737 A1 Sep. 16, 2010

(30) Foreign Application Priority Data

Oct. 4, 2007 (JP) ..... 2007-260726

(51) Int. Cl.
*B41C 1/24* (2006.01)

(52) U.S. Cl. ..... 101/32; 101/5

(58) Field of Classification Search ..... 101/32
See application file for complete search history.

(56) References Cited

U.S. PATENT DOCUMENTS

| | | | | |
|---|---|---|---|---|
| 2,263,893 | A * | 11/1941 | Schulman | 101/23 |
| 2,645,178 | A * | 7/1953 | Brainard et al. | 101/401.1 |
| 3,403,621 | A * | 10/1968 | Hurwitz et al. | 101/23 |
| 5,555,800 | A * | 9/1996 | Rice | 101/23 |
| 5,881,444 | A * | 3/1999 | Schaefer et al. | 29/527.1 |
| 7,807,001 | B2 * | 10/2010 | Zwadlo et al. | 156/64 |
| 2006/0137548 | A1 * | 6/2006 | Vetter | 101/38.1 |

FOREIGN PATENT DOCUMENTS

| | | | |
|---|---|---|---|
| JP | 48-86608 | A | 11/1973 |
| JP | 52-130719 | A | 2/1997 |
| JP | 2000-84636 | A | 3/2000 |
| JP | 2002-160345 | A | 6/2002 |
| JP | 2002-282977 | A | 10/2002 |
| JP | 2005-531428 | A | 10/2005 |

* cited by examiner

*Primary Examiner* — Anthony Nguyen
(74) *Attorney, Agent, or Firm* — Browdy and Neimark, PLLC

(57) ABSTRACT

A method is provided for ornamenting a container, a mandrel, drum, apparatus used for the method, in which the number of manufacturing processes and the manufacturing cost are reduced, and scratches are prevented in the inner and outer surface of the container. The ornamenting method of a container includes a process to perform underprinting, a process to perform outer surface printing, and a process to perform embossing on the surface of the container held by a holder in a manufacturing line. It is preferable that the outer surface printing process and the embossing process are simultaneously or successively performed.

9 Claims, 19 Drawing Sheets

(a)

(b)

METHOD FOR ORNAMENTING CONTAINER, ORNAMENTED CONTAINER MANUFACTURED BY THE METHOD, AND MANDREL, DRUM, AND ORNAMENTING APPARATUS USED FOR THE METHOD

FIELD OF THE INVENTION

This invention relates to a method for ornamenting a container, an ornamented container manufactured by the method, and a mandrel, a drum, and an ornamenting apparatus used for the method.

BACKGROUND ARTS

Up to now, aerosol containers, and full-open DI cans, in which an uneven engraved mark is applied by embossing and in which polychrome printing is applied in the vicinity of this embossed mark, are available in the market. The ornamenting process for these containers was performed by two separate machines, a first printing process by the printing machine and a second embossing process by the embossing machine. Such traditional printing methods are shown in Patent Document 1. A blanket barrel of the printing machine, and a blanket are provided. When the ink transferring to the blanket and a container is carried out, an ink contained in an ink doctor is sequentially transferred to a printing cylinder through a tinting roller, an ink fountain roller, and an ink distributing roller. A printing plate on which each pattern is engraved is attached to the periphery of these printing cylinders. Each ink is shifted to the printing plate. Then, these synthesized patterns are transferred to the blanket by contact with each other. Next, these synthesized patterns are printed on the surface of the container. The container is held by a plurality of mandrels provided on the circumference of a turn table, and the synthesized pattern is printed on the surface of the container by being placed in contact with the blanket.

After the printing, embossing is applied to the container surface by using an embossing device, which is a separate device from the printing device, as shown in Patent Document 1. Patent Document 1 includes a figure showing the cross sectional view, when an engraved portion is applied on the surface of the bottomed cylindrical container by embossing. A mandrel is inserted in the container, supporting the container. The mandrel is composed of an elastic member made of urethane resin, etc., attached on the periphery and an interior iron core.

Next, a formed body contacted and depressed to the surface of the container in order to apply an embossed mark to the surface of the container is made of metal, ceramics, cured resin etc. The formed body is supported by a shaft so as to be movable in a vertical direction or rotatable. In the surface of the formed body, a formed protrusion to form an engraved portion in the surface of the container is formed. By this formed protrusion, the engraved portion is formed on the surface of the container. When in press forming, the elastic member contacting inside of the container absorbs effectively a depressing force from outside and makes it easy to form the engraved portion (see Patent Document 1). Another method to apply an embossed mark has been used, in which the embossed mark is applied to the container surface by sandwiching between an inner mold and an outer mold.

Patent Document 1: Japanese Published Patent Application No. 2000-84636

DISCLOSURE OF INVENTION

However, in the traditional ornamenting method of a container, printing by a printing machine was performed first, and then embossing by an embossing machine which is a separate apparatus was performed. Or, embossing by an embossing machine was performed first, and then printing by a printing machine which is a separate apparatus was performed. In other words, since the printing and the embossing were performed in completely separate processes, it was very troublesome to align the position of the embossing portion and the printing portion. Moreover, the traditional ornamenting method needed many manufacturing processes and the manufacturing cost of the container was high.

This invention is devised focusing attention on such a problem. This invention is directed to provide a method for ornamenting a container, a mandrel used for the method, a drum, and an ornamenting apparatus, which can facilitate the position alignment of printing portion and the embossing portion, reduces the manufacturing processes need for a container, and reduces the manufacturing cost of the container.

The ornamenting method of the container of this invention is characterized that an embossing process is performed in the manufacturing line of the printing process where the container is held by a holding means in the manufacturing line.

In such an ornamenting method of a container, it is preferable that an underprinting process is performed before the outer surface printing process in the manufacturing line. And, it is preferable that the outer surface printing process and the embossing process are simultaneously or successively performed.

Moreover, it is preferable that the outer surface printing process and the embossing process are performed on the container held by one holding means.

Further, in the ornamenting method of a container held by one holding means, it is preferable that the holding means is a mandrel inserted into the container, in which the periphery of the mandrel corresponding to the surface of the container to be printed by the outer surface printing process is composed of hard material, and in which the periphery of the mandrel corresponding to the surface of the container to be embossed is composed of soft material.

An ornamented container of this invention is characterized in that the embossing process and the outer surface printing process are performed by the ornamenting method of this invention. As such ornamented container, an aerosol container, a tube container, a full-open type DI can, or a bottle container can be cited.

The mandrel of this invention holds a container by being inserted into the container, where the container has a printed outer surface being printed by an ink images and an embossed outer surface being embossed. The mandrel comprises a periphery portion corresponding to the printed outer surface composed of a hard material, and a periphery portion corresponding to the embossed outer surface composed of a soft material.

Such mandrel is preferable to be constituted of a core member having a column shape, the hard material having a cylindrical shape, the hard material arranged in the periphery of the core member, and the soft material having a cylindrical shape arranged in the periphery of the core member.

The drum of this invention is used for a printing machine which transfers the ink image to an outer surface of a container. The drum comprises an embossing plate for embossing the outer surface of the container in a perimeter.

Such drum is preferable to be provided with the embossing plate, an engraved plate and an intaglio plate for transferring ink images or a blanket used for offset printing, in the perimeter thereof. It is preferable to be provided with a blanket barrel, an embossing-blanket equipped with the embossing plate arranged in the perimeter of the blanket barrel, and the printing-blanket arranged in a perimeter of the blanket barrel.

The ornamenting apparatus of this invention is characterized in that it comprises a mandrel of this invention, a drum for embossing having an embossing plate in the perimeter, and a drum for printing having an engraved and an intaglio plate for transferring ink images to the container surface, or a printing-blanket used for offset printing in the perimeter thereof.

In such an ornamenting apparatus, it is preferable that the drum for embossing comprises a blanket barrel for embossing, an embossing-blanket having an embossing plate arranged in the perimeter of the blanket barrel, and in which the drum for outer surface printing comprises of a blanket barrel for printing and a printing-blanket arranged in the perimeter of the blanket barrel. Further, it is preferable that the embossing-blanket and the blanket for printing are identical.

EFFECT OF THE INVENTION

Since the ornamenting method of this invention performs embossing in the manufacturing line in which outer surface printing process is performed, printing and embossing can be applied to the container surface without using a separate line. Moreover, there is an advantage that traditional printing machines can be used. Further the number of manufacturing processes and the cost of manufacturing the container are reduced. Additionally the position alignment of ornamenting can be done easily when embossing and printing are performed by the same printing machine.

In such an ornamenting method of a container, in the case that an underprinting process is performed and then an outer surface printing process is performed, the ornamenting of the container can be easily performed. And, in the case that the outer surface printing process and the embossing are performed simultaneously or successively, the process of printing and embossing can be performed in a short time.

In the case that the printing process and the embossing process are performed on the container held by one holding means, printing and embossing can be performed on the container surface without detaching the container, and the manufacturing line can be shortened.

In the case that the holding means is a mandrel inserted into the container, and a periphery portion of the mandrel corresponding to the surface of the container to be printed by the printing process is composed of a hard material, and a periphery portion of the mandrel corresponding to the surface of the container to be embossed by the embossing process is composed of a soft material, the printing design and the embossing design on the container can be clearly obtained.

The ornamented container of this invention is suitable for low cost and mass production, because the multiplier effect of the ornamenting effect by embossing and the ornamenting effect by character/pattern print according to the ornamenting method of this invention can be expected.

The mandrel of this invention is to hold a container by inserting into the container having a printed outer surface being printed by an ink images and an embossed outer surface being embossed. The mandrel comprises the periphery portion corresponding to the printed outer surface composed of hard material, and the perimeter portion corresponding to the embossed outer surface composed of soft material. Therefore the container surface can be ornamented clearly, even when printing and embossing are performed while the container is held by this mandrel.

In the case that the mandrel is constituted of the column shaped core member and a soft material arranged in the perimeter of the core member, and the cylindrical elastic material arranged in the perimeter of the core member, the arrangement of the hard material and the soft material can be changed easily according to ornamenting designs.

The drum of this invention is used for a printing machine to transfer ink images to the container surface. Since an embossing plate for performing embossing on the container surface is provided in the perimeter, embossing can be performed by rotating the drum while depressing it to the container surface.

In the case that such drum is provided with the embossing plate, the engraved and the intaglio plate for transferring ink images or the printing-blanket used for offset printing in the perimeter thereof, printing and embossing can be performed by rotating the drum while depressing it to the container surface.

In the case that the drum is provided with the blanket barrel, the embossing-blanket arranged with the embossing plate in the perimeter of the blanket barrel, and the printing-blanket, it is suitable for mass production because of its high durability.

The ornamenting apparatus of this invention comprises the mandrel of this invention, the drum for embossing provided with the embossing plate for performing embossing on the container surface in the perimeter thereof, and the drum for printing provided with the engraved plate and the intaglio plate for transferring ink images to the container surface or the blanket for offset printing in the perimeter thereof, the container held by the mandrel can be put on the manufacturing line and embossing and printing can be performed.

In the case that the drum for embossing comprises a blanket barrel for embossing, a embossing-blanket equipped with an embossing plate arranged in the perimeter of the blanket, and the drum for printing having a blanket barrel for outer surface printing and a printing-blanket arranged in the perimeter of the blanket barrel, the simplification of the apparatus can be realized.

In the case that the blanket for embossing and the blanket for outer surface printing is identical, further simplification can be realized.

BEST MODE FOR CARRYING OUT THE INVENTION

Figure 1:
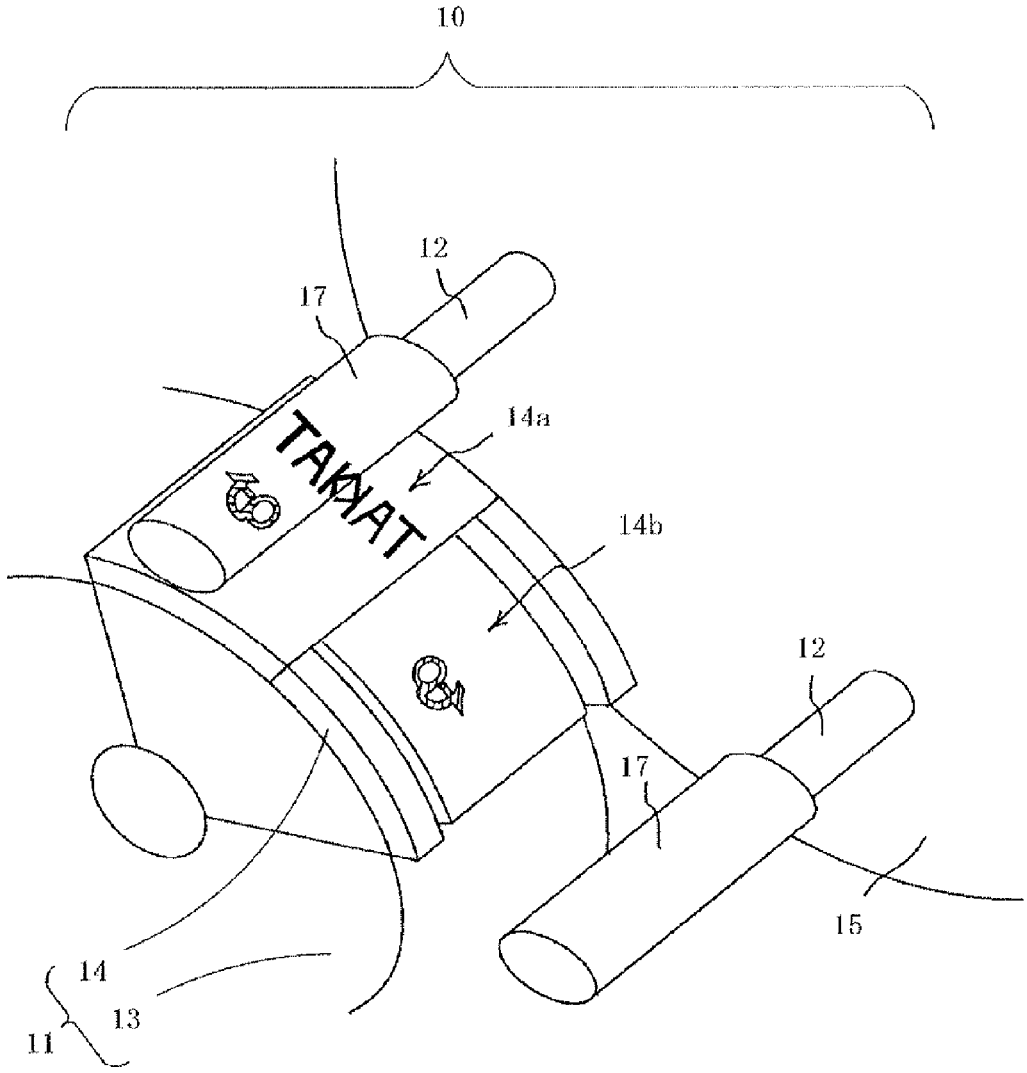
FIG. 1 is an outline drawing showing an embodiment of the ornamenting method of this invention.

The embodiments of this invention are described using drawings.

The ornamenting apparatus 10 of this invention comprises a drum 11 and a mandrel 12 for holding a container. This ornamenting apparatus 10 is constituted to perform the embossing and printing at one drum 11 (a blanket barrel 13 and a blanket 14).

Figure 8:
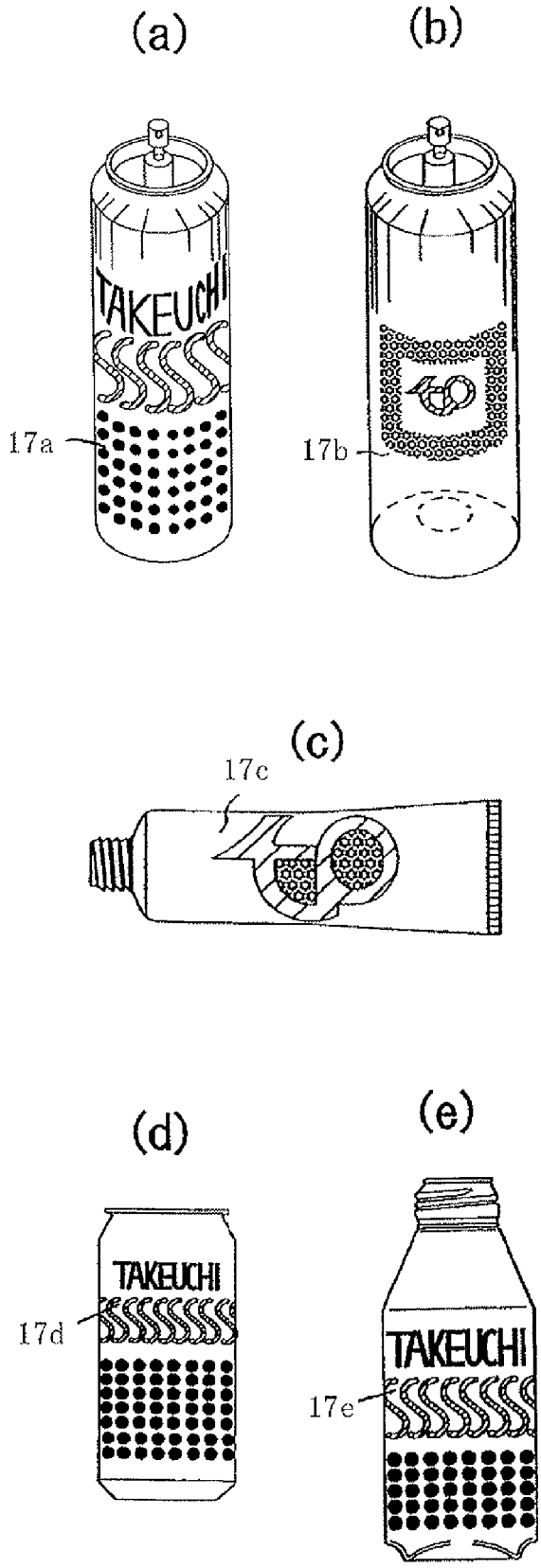
FIGS. 8*a-e* show the ornamented containers ornamented by the ornamenting method of this invention.

An aerosol container 17 made of aluminum or steel whose surface is ornamented by the ornamenting apparatus 10 is shown in FIG. 8*a*. The aerosol container 17*a* has a design arrangement where an engraved mark by embossing is applied between the printed designs provided above and below of the body part. But, this ornamenting apparatus 10 can ornament not only an aerosol container but also can ornament the container 17 having a cylindrical shape.

Figure 2:
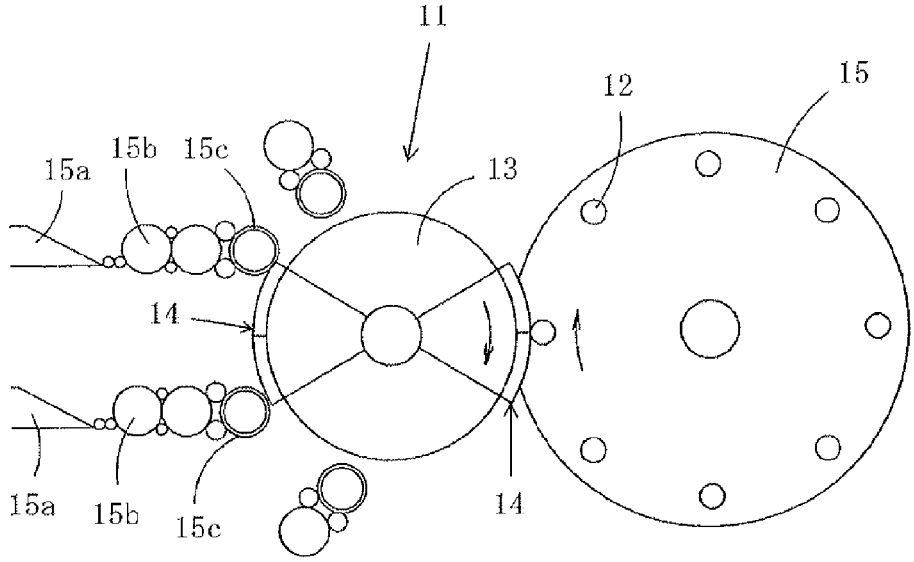
FIGS. 2*a, b* are outline drawings showing an embodiment of the drum of this invention respectively.
Figure 2:
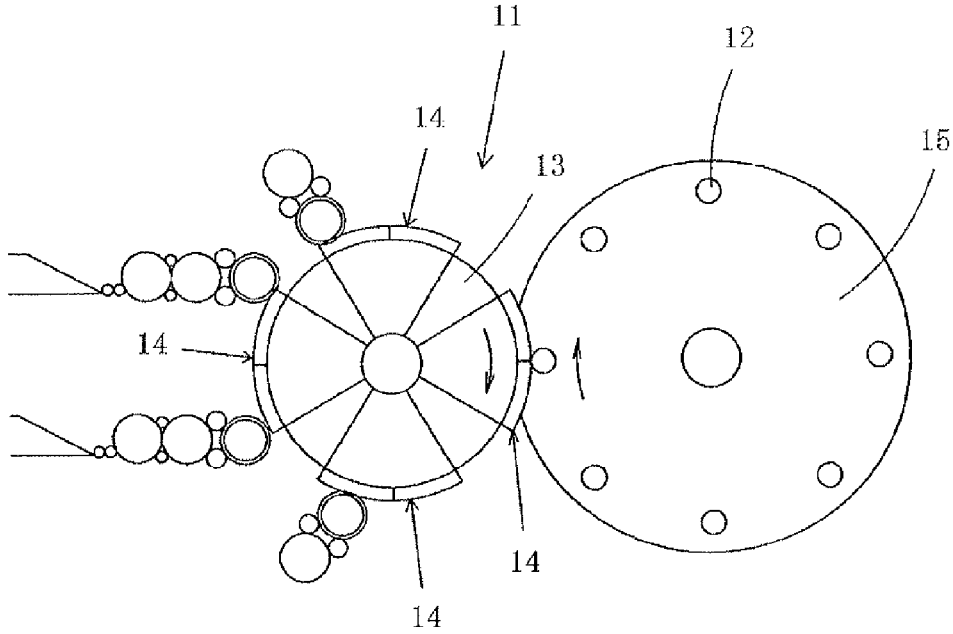
Figure 3:
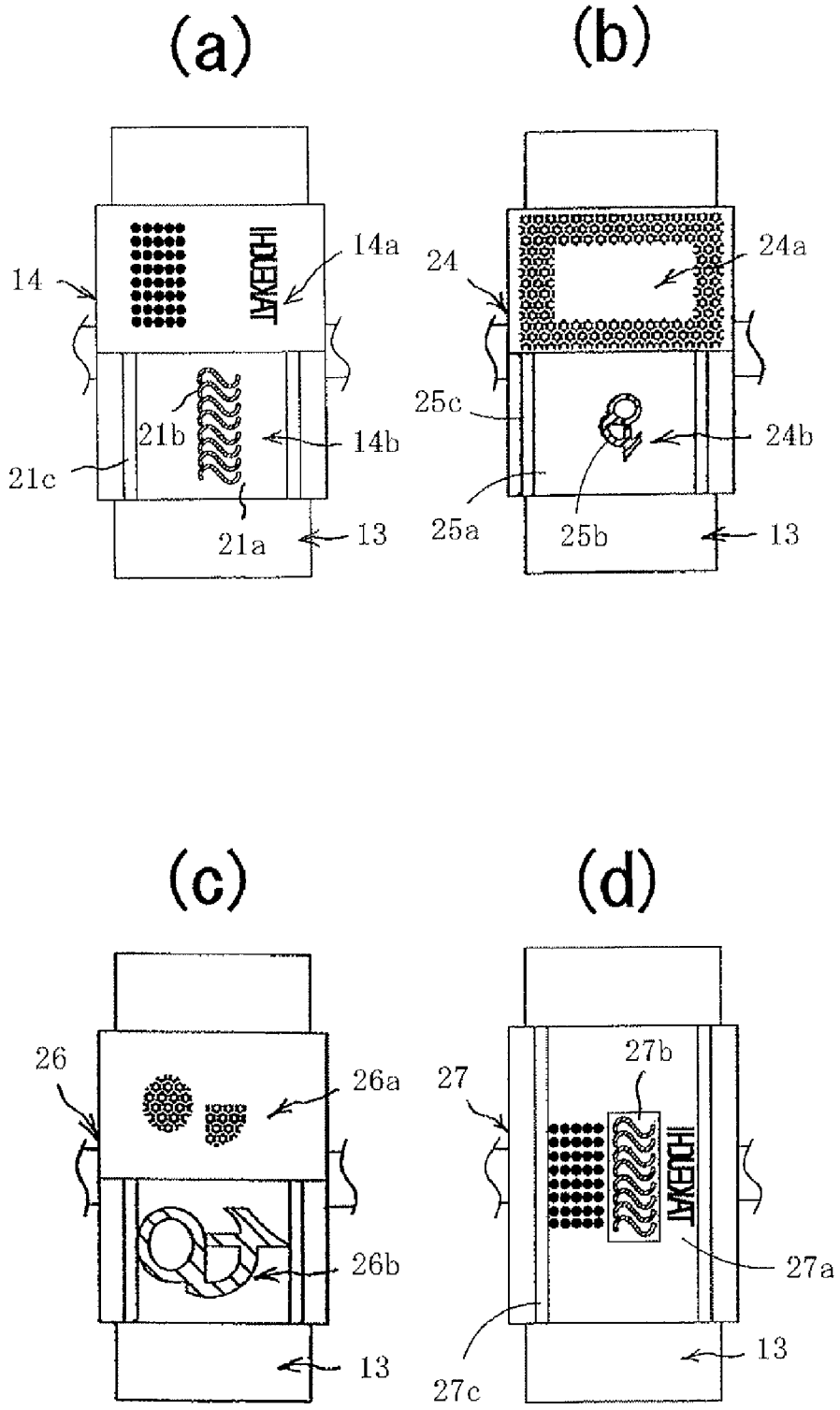
FIGS. 3*a-d* are the development view of an embodiment of the drum of this invention.
Figure 4:
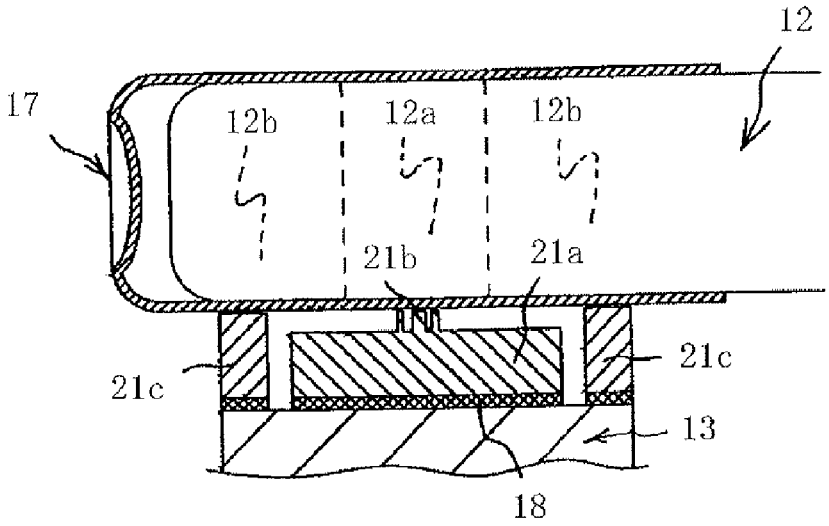
FIG. 4 is a side cross section showing a part of the printing process of this invention.

The drum 11 has a cylindrical blanket barrel 13 which rotates clockwise, and a blanket 14 attached in the periphery of the blanket barrel. The blanket barrel 13 is conventional one. The blanket 14 is composed of physically separated portions (see FIG. 1, FIG. 3*a*), and has a printing-blanket 14*a* (printing area) provided on an upper side with respect to the rotation direction and an embossing-blanket 14*b* (embossing area) provided under side to the rotation direction. Stated differently, when this drum 11 is used, embossing is performed first, and printing is performed successively. Hence, scratches won't be made on the inside and outside of the container. The blanket 14 is provided in the two positions opposed by 180 degrees of the blanket 13 (see FIG. 2*a*). However, the attaching position of the blanket may be four positions like shown in FIG. 2*b*, and it may be one position or three positions or more, the number is not particularly limited.

The printing-blanket 14*a* has printed designs in its right and left sections, and the middle part is made to be blank. This blanket is publicly known in the past, and it is made of elastic material such as natural rubber, synthetic rubber. The ink is transferred to this printing-blanket 14*a* in a conventional method. An ink housed in an ink doctor 15*a* is sequentially shifted to a printing plate 15*c* in which each pattern is engraved through a tinting roller 15*b* etc. And, it is transferred to the printing-blanket 14*a* by contacting this printing plate (see FIG. 2*a*).

The embossing-blanket 14*b* has an embossing plate 21*a* provided with an embossing portion 21*b*, and a slip prevention part 21*c* provided in the side edge of the embossing plate. The embossing portion 21*b* of the embossing plate 21*a* protrudes to the other portion of the embossing plate 21*a*. The embossing portion 21*b* embosses the container surface by depressing. Moreover, the slip prevention part 21*c* also contacts the surface of the container 17, so the container 17 is not idly rotated. The embossing portion 21*b* is provided in the center of the embossing plate 21*a*, and corresponds to the blank part of the printing-blanket 14*a*. The slip prevention part 21*c* is provided on the side edge of embossing plate 21*a* having the printing design on the printing-blanket 14*a*. The height, width etc. of the slip prevention part 21*c* can be adjusted in consideration of the size of the embossing portion 21.

The material of the embossing plate 21*a* is metal such as zinc, or a synthetic resin material harder than the material of the container. The material of the slip prevention part 21*c* is natural rubber, synthetic rubber, urethane resin, etc.

Both printing-blankets 14*a* and embossing blankets 14*b* are fixed to the blanket barrel 13 with an adhesive 18. However they may be adhered by an adhesive tape or a magnet, etc. The length of the blankets 14*a, b* is substantially the same as the circumference (one revolution) of the container 17. Therefore, when the container 17 rotates in the area of the blankets 14*a, b* without slipping, the container 17 makes just one revolution. As a result, the container 17 makes two revolutions on the blanket 14, if the embossing and the printing are complete. Moreover, the detailed position alignment between the embossing and the printing can be done easily by aligning a gauge line entered into the blanket barrel 13 at the end portion of the blanket for embossing (embossing area) and the end position of one revolution of the container 17 or a mark provided in the container. Thereby, the position displacement between the embossing and the printing of character/pattern can be suppressed to the minimum (0.2-0.3 mm). In this embodiment, the outer surface printing area and the embossing area are not overlapped.

Figure 5:
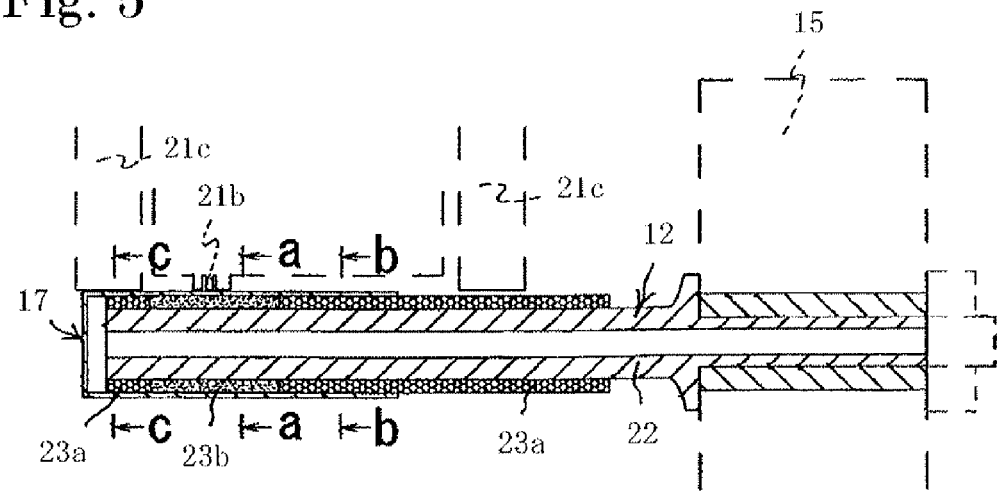
FIG. 5 is a side cross section showing an embodiment of the mandrel of this invention.
Figure 6:
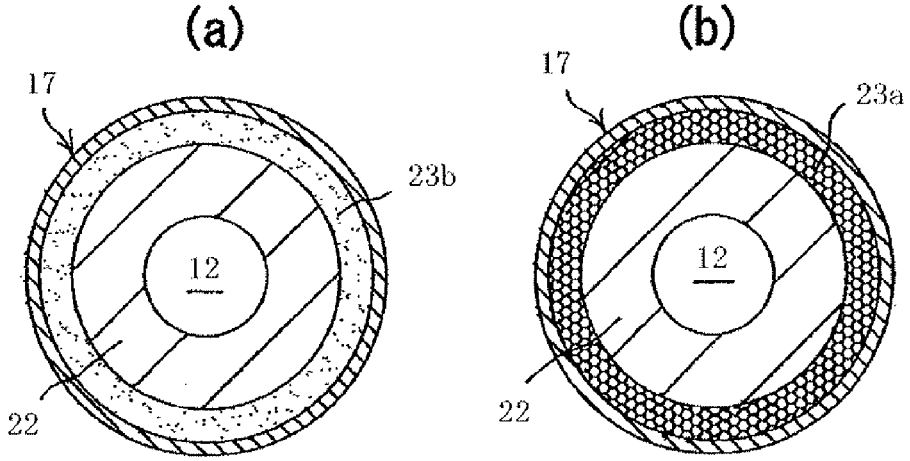
FIG. 6*a* is the a-a line cross section of FIG. 5.
FIG. 6*b* is the b-b line cross section of FIG. 5.

The mandrel 12 has column-shaped a iron core 22 and a cylindrical holding portion 23 provided in its periphery, as shown in FIG. 5 or FIG. 6. The holding portion 23 comprises a cylindrical soft portion 23*b* and a cylindrical hard portion 23*a*. The arrangement of the cylindrical soft portion 23*b* and the cylindrical hard portion 23*a* varies according to the design arrangement of printing and embossing. Since the mandrel 12 is held so as to rotate together with the container 17, the outer surface of the holding portion 23 and the inner surface of the container 17 are constituted so as to be in contact with one another. Since the mandrel 12 is for ornamenting the aerosol container 17*a* of FIG. 8*a*, in particular, since the mandrel 12 is for a container having a side surface that can be categorized into three parallel cylindrical portions such as a cylindrical lower portion (printing portion), a middle portion (embossing portion), and an upper portion (printing portion); the hard portion 23*a*, the soft portion 23*b*, the hard portion 23*b* are in line from the end. The mandrel 22 rotates as the iron core 22 rotates around a spindle extending from a turn table 15. But, the spindle may rotate, and if the mandrel is rotatable, the constitution is irrespective.

The mandrel 22 is preferable to be constituted so as to rotate in one direction only, but it may be rotatable in both directions.

The soft portion 23*b* is provided in the periphery of the iron core 22 corresponding to the surface of the container 17 where embossing is performed by the embossing-blanket 14*b*. As such soft portion 23*a*, synthetic resin having elasticity can be cited, urethane resin is preferable.

Meanwhile, the hard portion 23*a* is provided in the periphery of the iron core 22, other than the portion where the soft portion 23*b* is provided including the periphery of the iron core 22 corresponding to the surface of the container 17 where the ink images are transferred by the blanket 14*a* for outer surface printing. As such hard portion 23*b*, Bakelite, metals, ceramics, cured resin, etc. can be cited, particularly, Bakelite, or titanium-polymer resin are preferable.

Next, back to FIG. 1, the method for ornamenting a container using the ornamenting apparatus 10 is described. Here, the case in which the turn table 15 of the ornamenting apparatus 10 is intermittently rotated clockwise is described. By this, the container 17 is ornamented sequentially.

First, the underprinted container 17 is sequentially held by the mandrel 12 provided at equal intervals in the periphery of the turn table 15.

Figure 7:
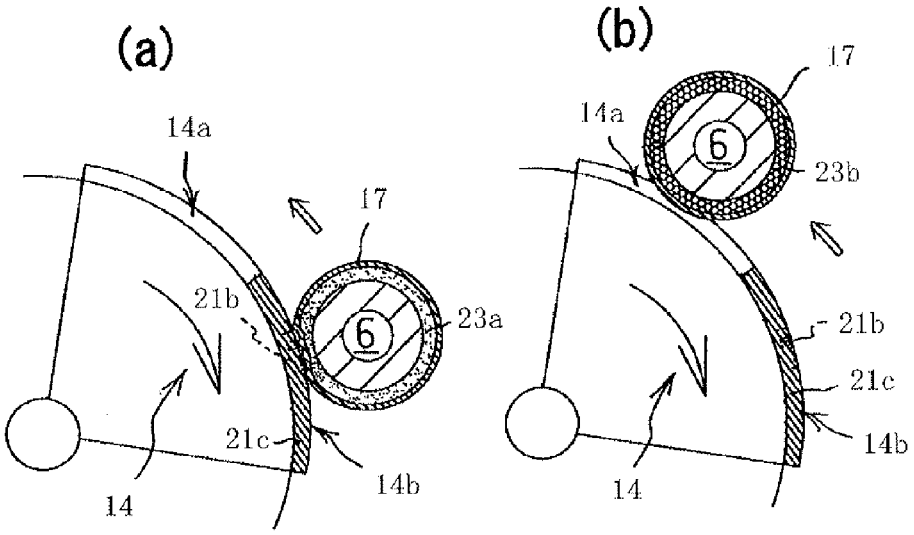
FIG. 7*a* is a side cross section showing the embossing process by the ornamenting apparatus of FIG. 1.
FIG. 7*b* is a side cross section showing the printing process by the ornamenting apparatus of FIG. 1.

Next, by rotating the turn table 15 intermittently, the container 17 held by the mandrel 12 fixed in the turn table 15 arrives at the embossing-blanket 14*b* (embossing area) provided on the lower side of the blanket 14, as shown in FIG. 7*a*. At this moment, the surface of the container 17 rotates while being depressed to the embossing portion 21*b*. Thereby, a desired embossed mark (mark) is applied to the surface of container 17. In this case, since the embossing plate 21*a* is harder than the material of the container 17 or at least the embossing portion 21*b* is harder than the material of the container 17, the embossing portion 21*b* bites into the soft portion 23*b* of the mandrel 12 through the container 17. Thereby, the mark of the embossing portion 21*b* can be clearly laid on the surface of the container 17. Further since the slip prevention part 21*c* is provided in the side edge of the embossing plate of the blanket 14*b*, the surface of the container 17 and the blanket 14*b* rotates and moves without slipping. And, since the length of the blanket 14*b* is made to be same as the circumference of the aerosol container 17, the container passes through the blanket 14*b* with just one revolution.

Further, after the completion of embossing, the container 17 arrives at the blanket 14*a* (printing area) provided on upper side of the blanket 14, as shown in FIG. 7*b*. Since the container 17 makes just one revolution when passing through the blanket 14*b* for embossing, the position alignment after embossing is easy. Therefore, the surface of the container 17 is depressed to the blanket 14*a*, and the ink of synthesized pattern shape transferred from the ink doctor is printed on the surface of the container from the blanket 14*a*. Since the blanket 14*a* is composed of elastic material, the blanket 14*a* for printing dents being depressed by the hard portion 23*a*. Thereby, the character/pattern printing is securely applied to the container 17 by the printing-blanket 14*a* (printing area). At this moment, the container 17 moves by rotating on the printing-blanket 14*a*. And, the length of the printing-blanket 14*a* is made to be same as the circumference of the container 17, the container 17 passes through the printing-blanket 14*a* with just one revolution.

The ornamenting apparatus 10 applies embossing and printing on the surface of the container to be ornamented by only passing through the blanket 14 provided on the one blanket barrel 13.

Moreover, according to the material of the container 17 to be ornamented, embossing and printing may be ornamented by adding suitable heat on the container or the embossing portion, more beautiful ornamented containers can be manufactured.

In this embodiment the turn table 15 of the ornamenting apparatus 10 in which rotates clockwise was described, but in the case where it is rotated anti-clockwise, the sequence of the outer surface printing and the embossing are reversed.

Moreover, in this embodiment the drum for offset printing was described, but the same effect can be obtained by providing the embossing plate to the drum of a printing machine using an engraved plate and an intaglio plate.

Next, in a blanket 24 of FIG. 3*b*, a rectangular printing design is provided in the printing-blanket 24*a* whose median is blank. The embossing-blanket 24*b* having an embossing portion 25*b* provided in an embossing plate 24*a* is provided so as to correspond to the blank section of the printing-blanket 24*a*. Stated differently, the design arrangement is made so that the embossing mark is surrounded by a rectangular printed pattern. Moreover, a slip prevention part 24*c* is provided in the edge side of the printing design of the blanket 24*a*.

A mandrel 12*a* used together with the blanket 24 is provided with a cylindrical soft portion 23*b* in the periphery of the iron core 22, and the soft portion 23*b* is vacant in the portion only where embossing is applied, and the hard portion 23*a* is fitted in this vacant portion by adhesives etc. A part of the hard portion 23*a* is cut out, and a soft portion 23*b* may be provided in the portion. Thus, since printing and embossing is formed in the same circumference of the barrel of the container, the arrangement of the hard portion 23*a* and the soft portion 23*b* of the mandrel 12 becomes complicated.

The other configurations are substantially the same as the ornamenting apparatus equipped with the blanket 14 of FIG. 3*a* and the mandrel 12 of FIG. 5. An aerosol container 17*b* ornamented by this ornamenting apparatus equipped with the blanket 24 and the mandrel 12*a* is shown in FIG. 8*b*.

And in the blanket 26 of FIG. 3*c*, the embossing-blanket 26*b* is provided with a character design, and a printing-blanket 26*a* is provided so as to tint the portion surrounded by the character design. The arrangement of the soft portion 23*b* and the hard portion 23*a* of the mandrel is arranged according to the design. The other configurations are same as the ornamenting apparatus using the blanket 24 of FIG. 3*b*. A tube container 17*c* made of metal or made of synthetic resin ornamented by the ornamenting apparatus equipped with the blanket 26 is shown in FIG. 8*c*.

Further, a blanket 27 of FIG. 3*d* has an embossing-blanket 27*b* (embossing area) provided in a printing-blanket 27*a* (printing area). In other words, a part of the printing-blanket 27*a* is cut out, while the embossing-blanket 27*b* or an embossing portion is fixed in this part by adhesives, etc. A slip prevention part 27*c* is provided wholly in the side edge of the blanket 27. In this case, it is made to be of a length in which the container 17 rotates on the blanket 27. Since this ornamenting design is made to be same as the blanket 14 of FIG. 3*a*, the mandrel 12 of FIG. 5 is used. A full-open DI can 17*d* made of aluminum or steel, or a bottle container 17*e* made of metal or made of synthetic resin is respectively shown in FIG. 8*d, e*.

Next, a manufacturing line to manufacture a container is described with reference to FIG. 9. First, a disk-shaped metal slug (process (a)) is formed into a bottomed cylinder shape by impact forming etc. (process (b)), and the upper edge is regularized to form the container (process (c)). Then, a primary washing of the interior surface of the container is carried out (process (d)), and the interior surface coating is carried out (process (e)).

The embodiment of this manufacturing line is characterized in that the embossing is performed (process (g), printing 30*a*, embossing 30*b*) in one manufacturing line, together with the underprinting or before and after the underprinting, or together with the outer surface printing or before and after the outer surface printing.

And, after ornamenting the surface of the container by the ornamenting method of this invention, for example, the shape of the container is regularized by necking process (process (h)), curling process (process (i)), and a secondary washing (process (j)) is carried out wholly to complete.

Figure 9:
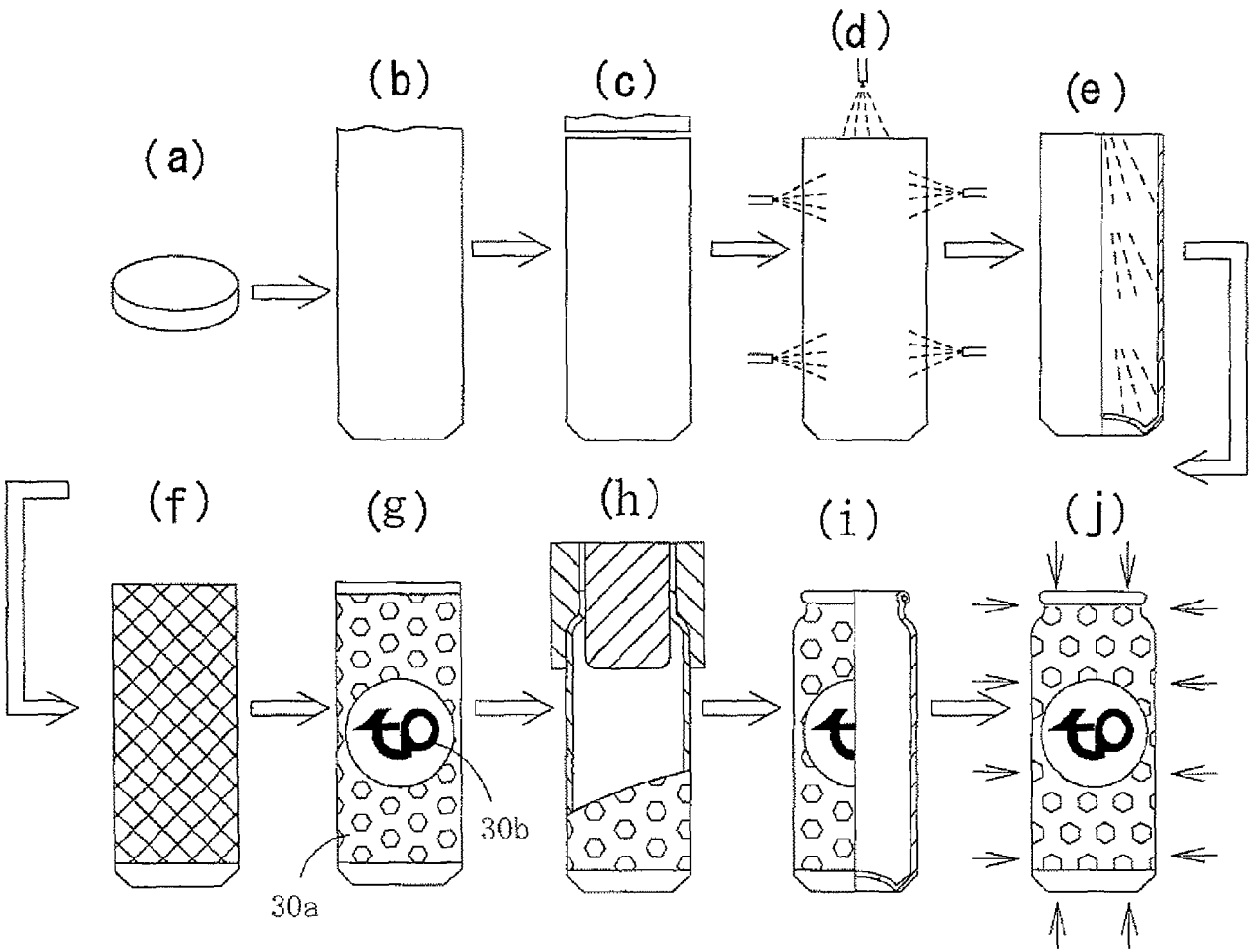
FIG. 9 is an outline drawing showing the manufacturing process of the ornamenting apparatus of this invention.

In FIG. 9, the underprinting process, the outer surface printing process, and embossing are performed after the interior surface coating. However, the interior surface coating may be performed after ornamenting the container surface, and it may be performed during the outer surface printing process or the embossing process. Particularly, when the container is manufactured by a drawing process, it is preferable to perform the interior surface coating after the outer surface printing, and then to perform the necking process, etc.

Next, the specific process of the method for ornamenting a container of this invention is described.

Figure 10:
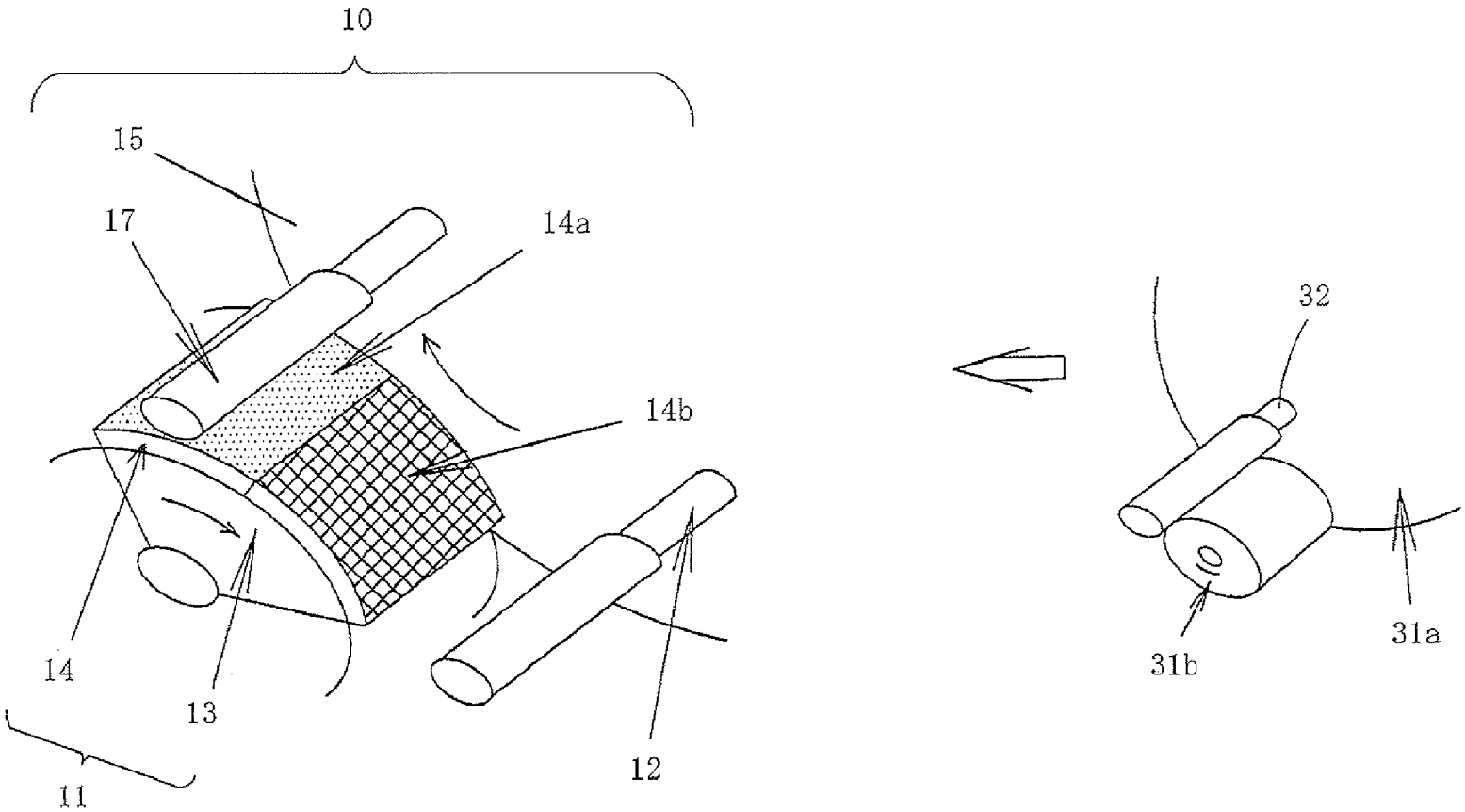
FIG. 10 is an outline drawing showing an embodiment of ornamenting method of this invention.

FIG. 10 is a method to perform underprinting first on the surface of a container, then to perform outer surface printing and embossing, using the ornamenting apparatus 10 of FIG. 1.

The underprinting is performed by an underprinter 31*a* and an underprinting roller 31*b*. The underprinting is performed on the surface of the container 17 held by a mandrel 32 of the underprinter, and after that it is dried.

Then, the container 17 is detached from the mandrel 32 of the underprinter, and inserted into the mandrel 12 attached to the turn table 15 as FIG. 1. And, the outer surface printing and the embossing is performed successively, by the ornamenting apparatus 10 of FIG. 1. The arrangement of the hard portion 23*a* and the soft portion 23*b* of the mandrel 12 is determined suitably according to the design.

Figure 11:
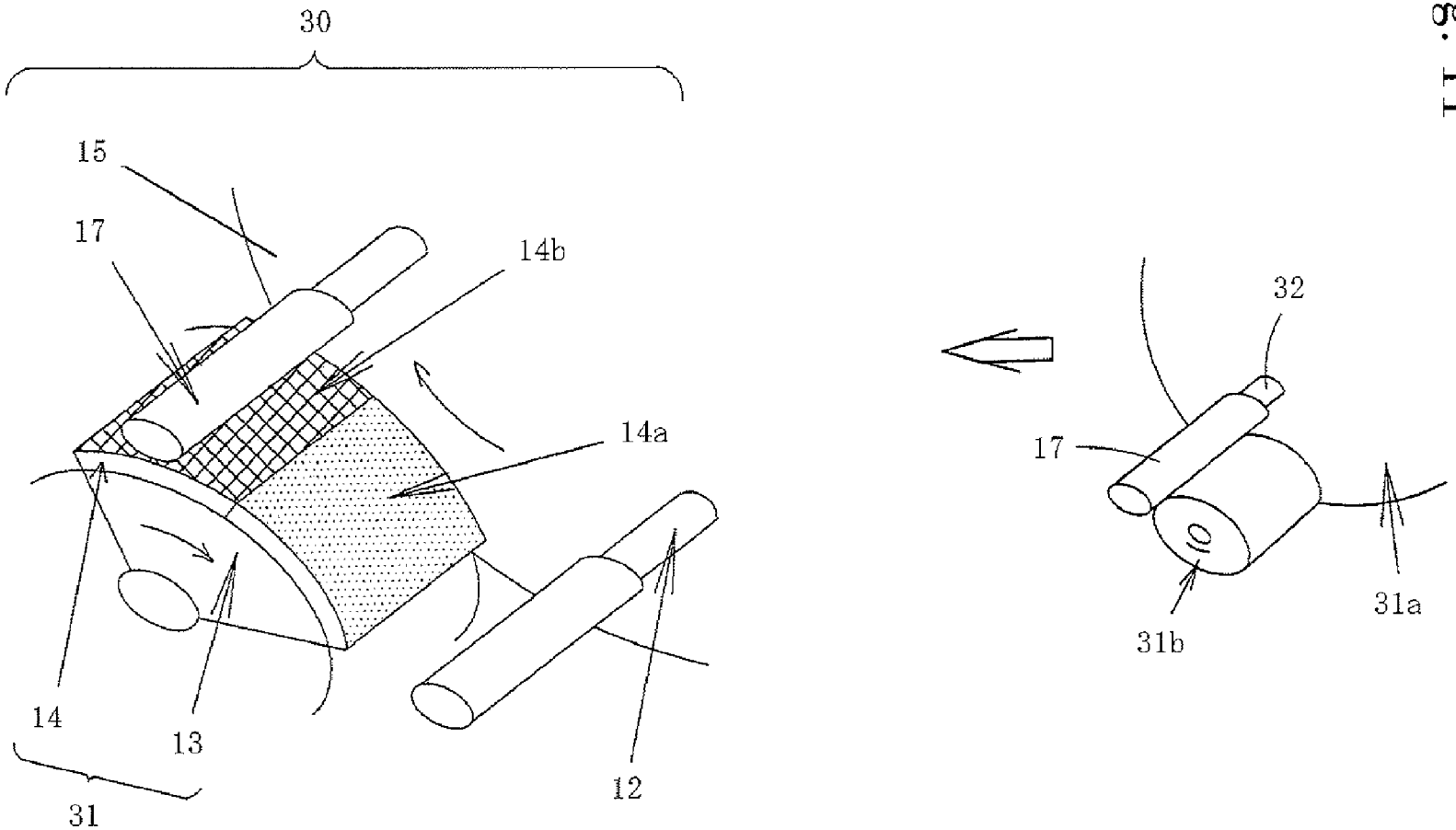
FIG. 11 is an outline drawing showing the other embodiment of ornamenting method of this invention.

The ornamenting method of FIG. 11 is a method to perform underprinting on the surface of a container, and then to perform embossing and outer surface printing sequentially.

An ornamenting apparatus 30 used for this ornamenting method is equipped with a drum 31 in which the embossing-blanket 14*b* is arranged on upper side with respect to the rotating direction of the blanket barrel 13 and the printing-blanket 14*a* is arranged on lower side with respect thereto. The other configurations are substantially the same as the ornamenting apparatus 10 of FIG. 1.

The container is to be held to the mandrel 12 after performing the underprinting by the underprinter 31*a* and the underprinting roller 31*b* and dried. Hence, the embossing and the outer surface printing are successively applied to the surface of the container as the turn table 15 rotates in a clockwise direction.

Figure 12:
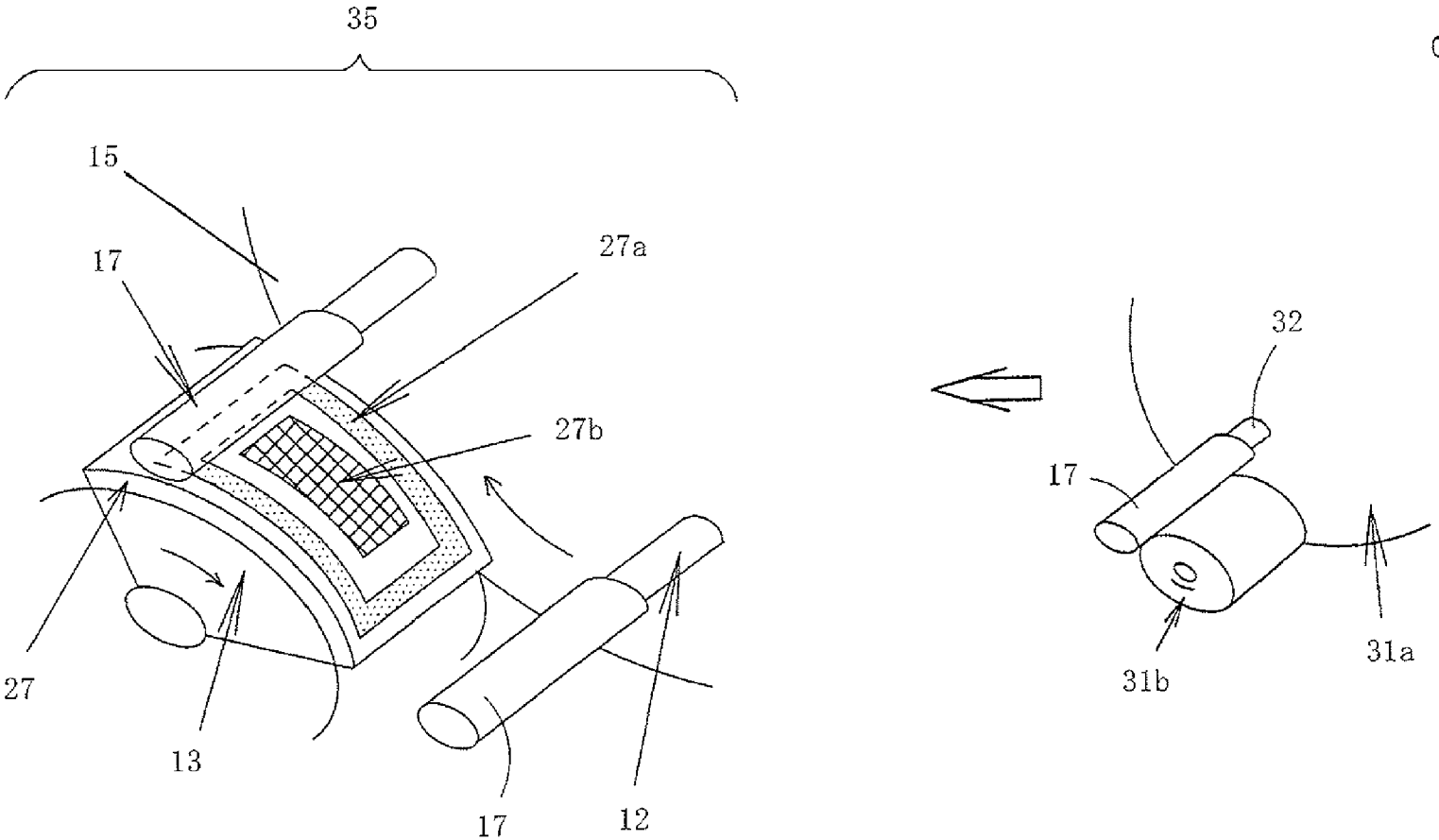
FIG. 12 is an outline drawing showing further the other embodiment of ornamenting method of this invention.

The ornamenting method of FIG. 12 is a method to perform underprinting on the surface of a container, and then embossing and outer surface printing are performed simultaneously. An ornamenting apparatus 35 used for this method is equipped with a blanket 27 of FIG. 3*d*.

The container is to be held on the mandrel 12 after performing underprinting by the underprinter 31*a* and the underprinting roller 31*b* and dried. Hence, when the turn table 15 is rotated in a clockwise direction, the embossing and the outer surface printing are simultaneously applied to the surface of the container. This invention can be applied similarly to a manufacturing line of drink containers, etc. having a drawing process.

Figure 13:
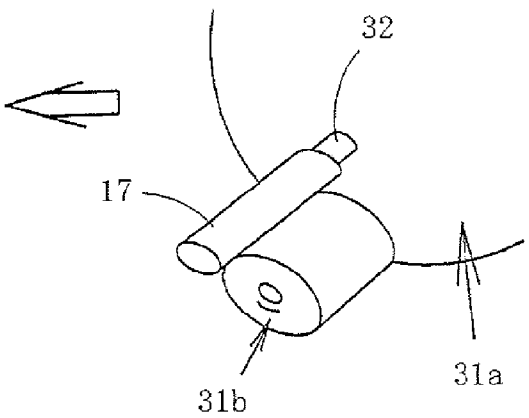
FIG. 13 is an outline drawing showing further the other embodiment of ornamenting method of this invention.
Figure 13:
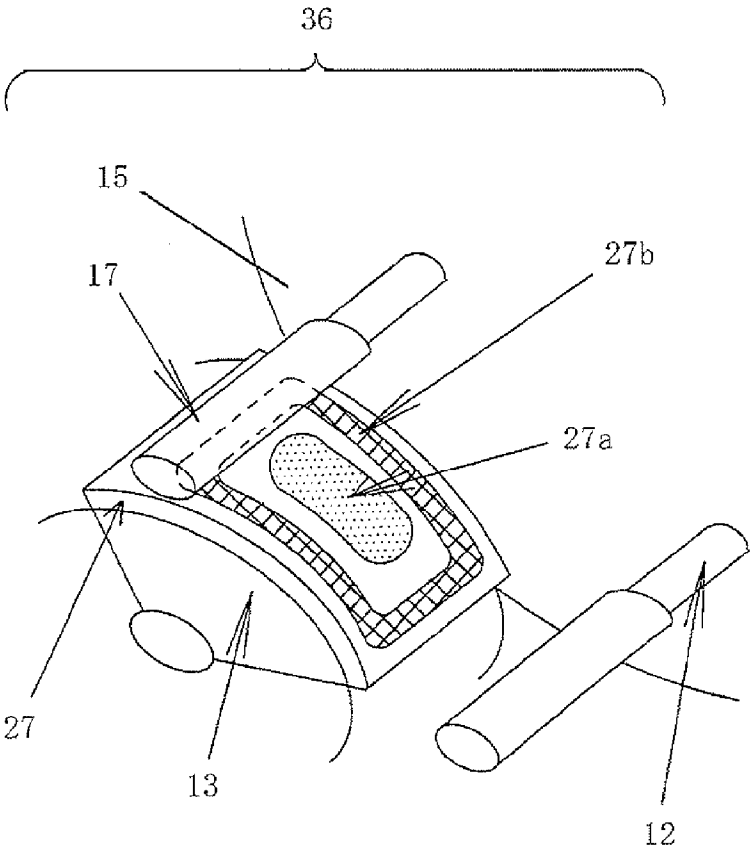

The ornamenting method of FIG. 13 is the same as the ornamenting method of FIG. 12, a method to perform underprinting on the surface of a container, and then embossing and outer surface printing are performed simultaneously.

In the ornamenting apparatus 36 used for this method, a printing-blanket 27*a* (printing area) is provided in an embossing-blanket 27*b* (embossing area). A part of the embossing-blanket 27*b* is cut out, and the printing-blanket 27*b* is fixed to this vacant portion by adhesives, etc. The arrangement of the embossing-blanket and printing-blanket are reversed with respect to the blanket 27 of FIG. 3. The other configurations are substantially the same as the ornamenting apparatus used in FIG. 12.

The container is held on the mandrel 12 after performing the underprinting by the underprinter 31*a* and the underprinting roller 31*b* and dried. Hence, the embossing and the outer surface printing are simultaneously applied to the surface of the container by rotating the turn table in a clockwise direction.

Figure 14:
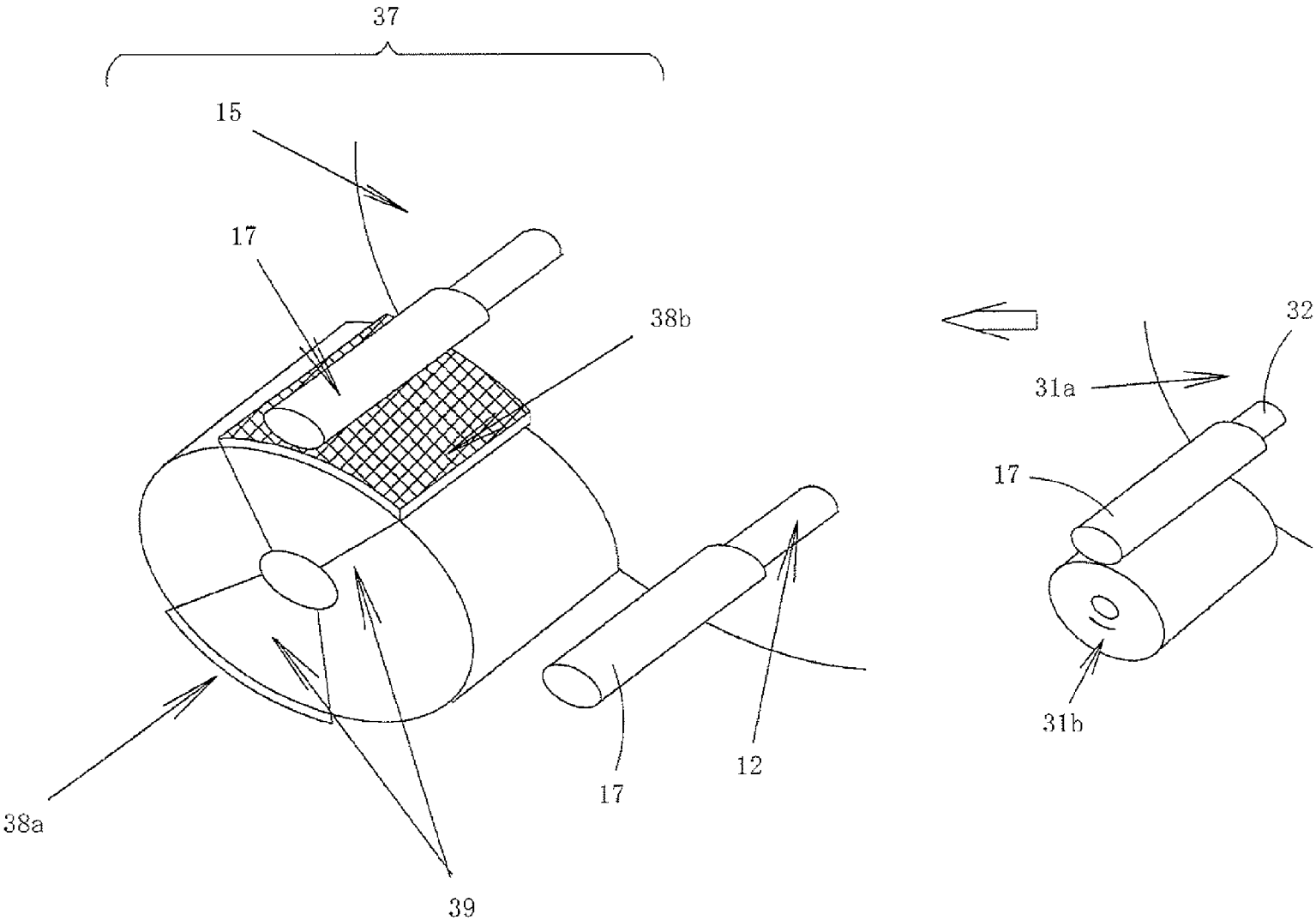
FIG. 14 is an outline drawing showing further the other embodiment of ornamenting method of this invention.

The ornamenting method of FIG. 14 is a method to perform underprinting on the surface of a container, and then embossing and outer surface printing can be performed in an arbitrary sequence.

In an ornamenting apparatus 37 used for this method, a printing-blanket 38*a* and an embossing-blanket 38*b* are provided on a blanket barrel 39 spaced apart from one another. Particularly in this embodiment, they are provided at 180 degrees intervals from one another. However, a plurality of them may be provided.

In this ornamenting method, underprinting by the under printer 31*a* and the underprinting roller 31 and drying is performed before rotating the turn table 15. Then, the surface of the container is positioned so as to first contact either the printing blanket 38*a* or the embossing blanket 38*b* when the turn table 15 is rotated in a clockwise direction. Therefore, the printing and the embossing or embossing and printing are performed in sequence. In this method, the sequence of the printing and the embossing are determined according to the positioning of the container before contacting the blanket. Further, by providing the slip prevention part wholly in the blanket barrel, the blanket barrel and the container turns without slipping and the position alignment will become easy.

Figure 15:
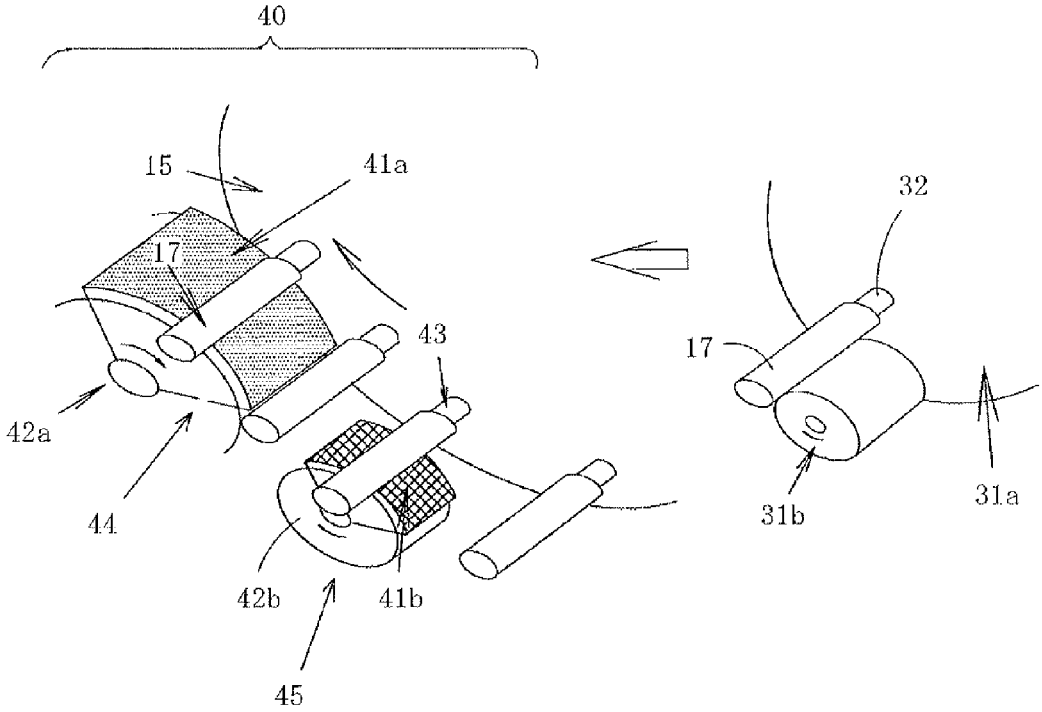
FIG. 15 is an outline drawing showing further the other embodiment of ornamenting method of this invention.

The ornamenting method of FIG. 15 is a method in which underprinting is performed on the surface of a container, then embossing and outer surface printing are sequentially performed. The printing-blanket 41*a* and the embossing-blanket 41*b* are provided in a different blanket barrel 42*a, b*.

An ornamenting apparatus 40 used for this ornamenting method comprises a mandrel 43 to hold a container attached to the turn table 15, a printing-drum 44 for outer surface printing, and an embossing drum 45 for embossing. The printing-drum 44 has a blanket barrel 42*a* and a blanket 41*a* attached on its periphery. The embossing-drum 45 has a blanket barrel 42*b* and a blanket 41*b* attached on its periphery. The embossing-drum 45 is constituted so as to contact the container first. Moreover, in the portion before the container and the printing-drum 44 contact, a position alignment means of a printing portion is provided.

A container is held to the mandrel 43 after the underprinting is performed by an underprinter 31*a* and an underprinting roller 31*b* and dried. Hence, when the turn table is rotated in a clockwise direction, the embossing is performed on the surface of the container, then the outer surface printing is performed.

In this embodiment, it is constituted so that the outer surface printing is performed after the embossing is performed. However, the arrangement of the drum 44, 45 can be reversed so that the embossing is performed after the outer surface printing is performed. In this case, the position alignment means of the container is arranged in the portion before it contacts the drum 45 for embossing.

Figure 17:
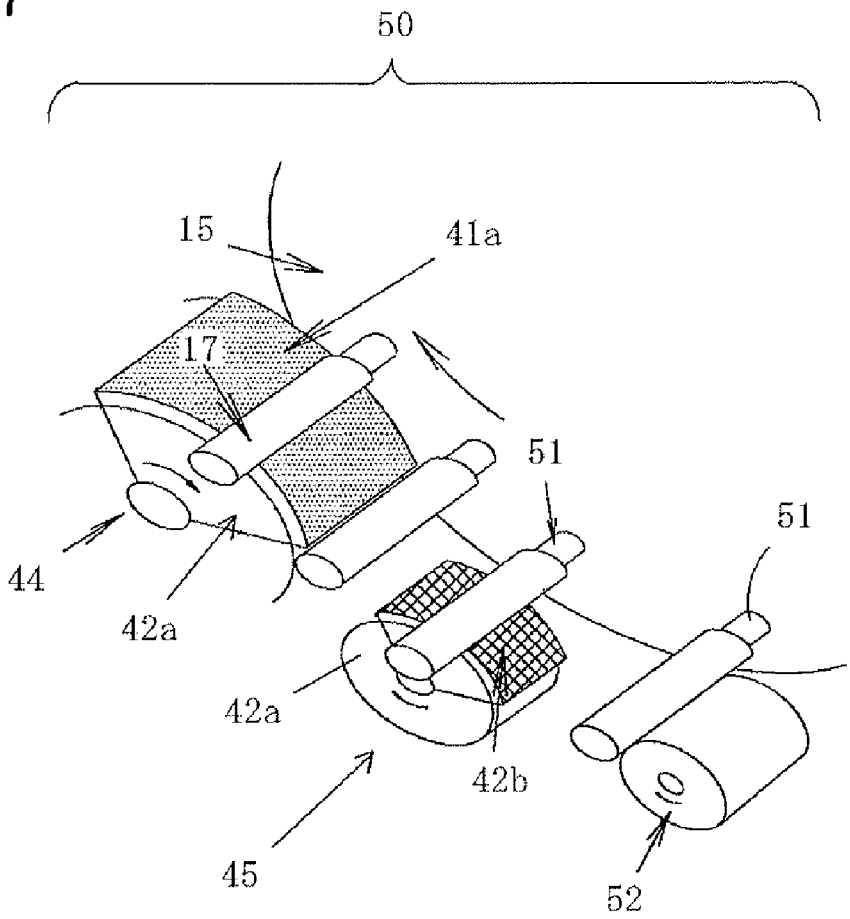
FIG. 17 is an outline drawing showing further the other embodiment of ornamenting method of this invention.

The ornamenting method of FIG. 17 is a method in which underprinting, embossing, and outer surface printing is successively performed without detaching a container held by the mandrel of the turn table.

An ornamenting apparatus 50 used for this ornamenting method has a mandrel 51 to hold a container attached to the turn table 15, an underprinting roller 52, the printing-drum 44 for outer surface printing, and the embossing drum 45 for embossing. The underprinting roller 52 has a cylindrical shape and is formed from natural rubber, synthetic rubber, etc, like the conventional one. In this case, it is preferable to use quick-drying ink as the ink for underprinting for miniaturizing the whole of the apparatus including the turn table. As such quick-drying ink, ultraviolet curing ink, etc. can be cited. The printing-drum 44 and the embossing-drum 45 are same as those of FIG. 15, and other than that an underprinting roller 52 is added to the one process of the turn table, it is substantially the same as the ornamenting apparatus 40 of FIG. 15.

Hence, when the ornamenting apparatus 50 is operated while a container is held by the mandrel 51, the underprinting, the embossing, and the outer surface printing are sequentially performed on the surface of the container.

Figure 16:
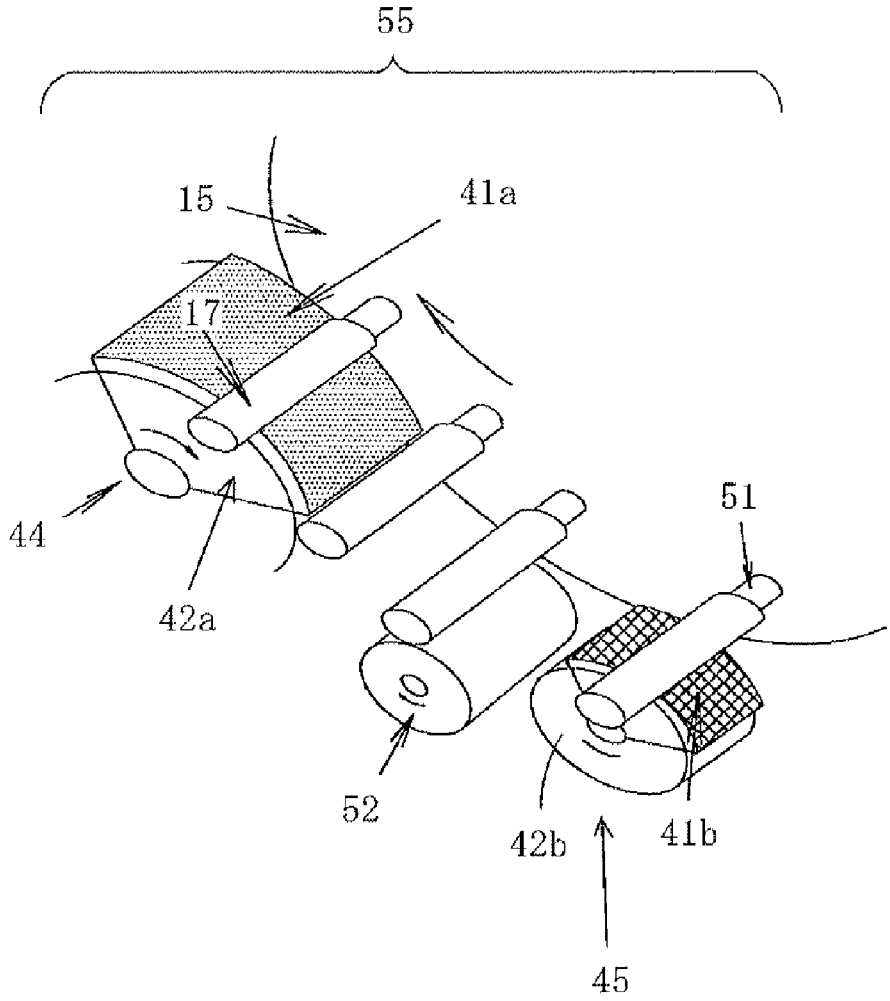
FIG. 16 is an outline drawing showing further the other embodiment of ornamenting method of this invention.

The ornamenting method of FIG. 16 is a method in which embossing is performed on the container surface, and underprinting, outer surface printing is performed afterward. In the ornamenting apparatus 55 used for this method, the arrangement of the underprinting roller 52 and drum 45 is reversed. The other configurations are substantially the same as those of the ornamenting apparatus 50 of FIG. 16. Thereby, after embossing is performed, the underprinting, the outer surface printing can be sequentially performed on the surface of a container.

Figure 18:
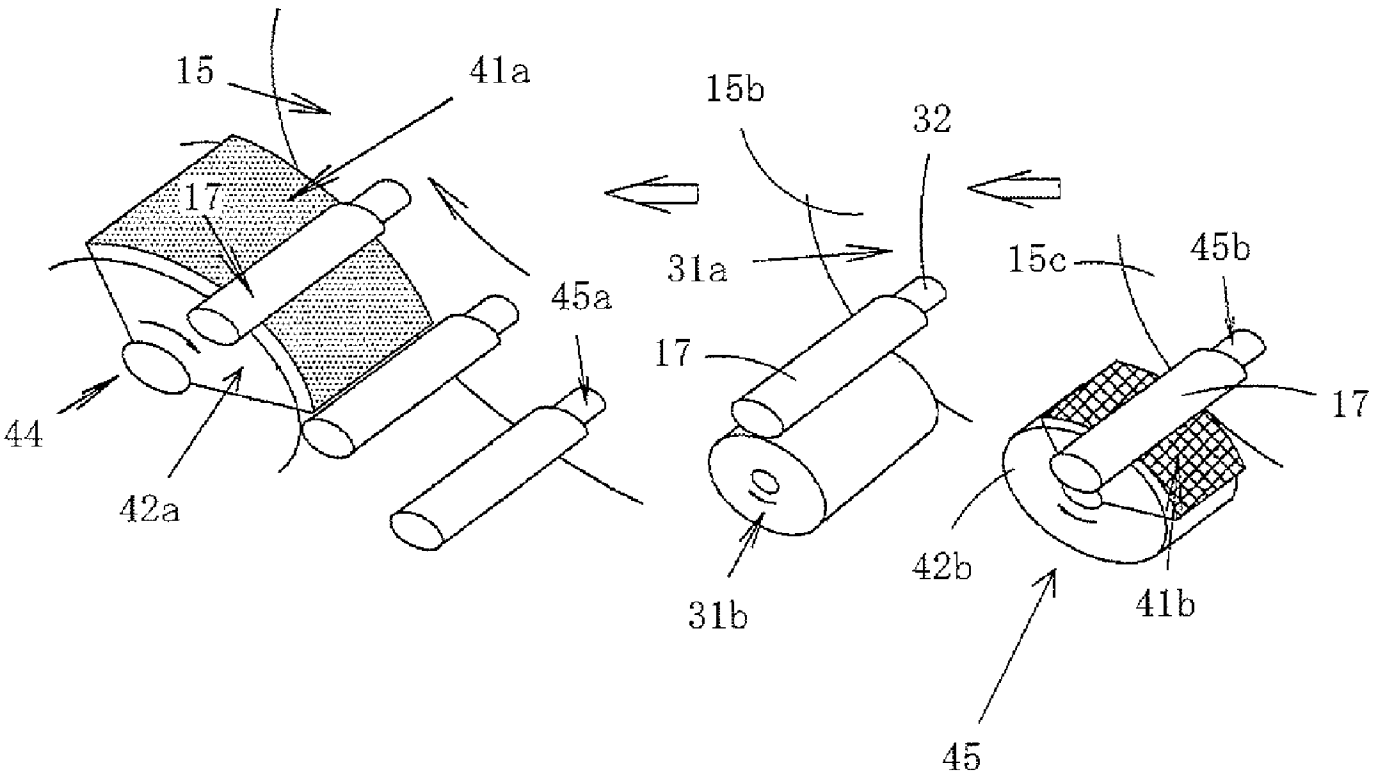
FIG. 18 is an outline drawing showing further the other embodiment of ornamenting method of this invention.

The ornamenting method of FIG. 18 is a method in which embossing is performed on the surface of a container, then, underprinting is performed, and outer surface printing is performed at the last step.

In this method, containers are held by mandrels of different turn tables, and containers are ornamented respectively by the embossing-drum 45, the underprinting roller 52, and the printing-drum 44. Prior to the process of the printing-drum 44, the position alignment means of the container is provided.

In this case, the mandrel having the hard portion and the soft portion being arranged according to the ornamenting design may be used for both the printing-drum 44 and the embossing-drum 45. But each mandrel for the embossing drum 45, and the printing-drum 44 may be used. In the case that the separate mandrels are used, the embossing-drum 45 having the soft portion provided in whole circumference of the iron core is preferable and the printing-drum 44 having the hard portion provided in the whole circumference of the iron core is preferable. Further, when two mandrels are used, the portion to be printed and the portion to be embossed can be overlapped in the surface of the container, which expands the width of design.

Figure 19:
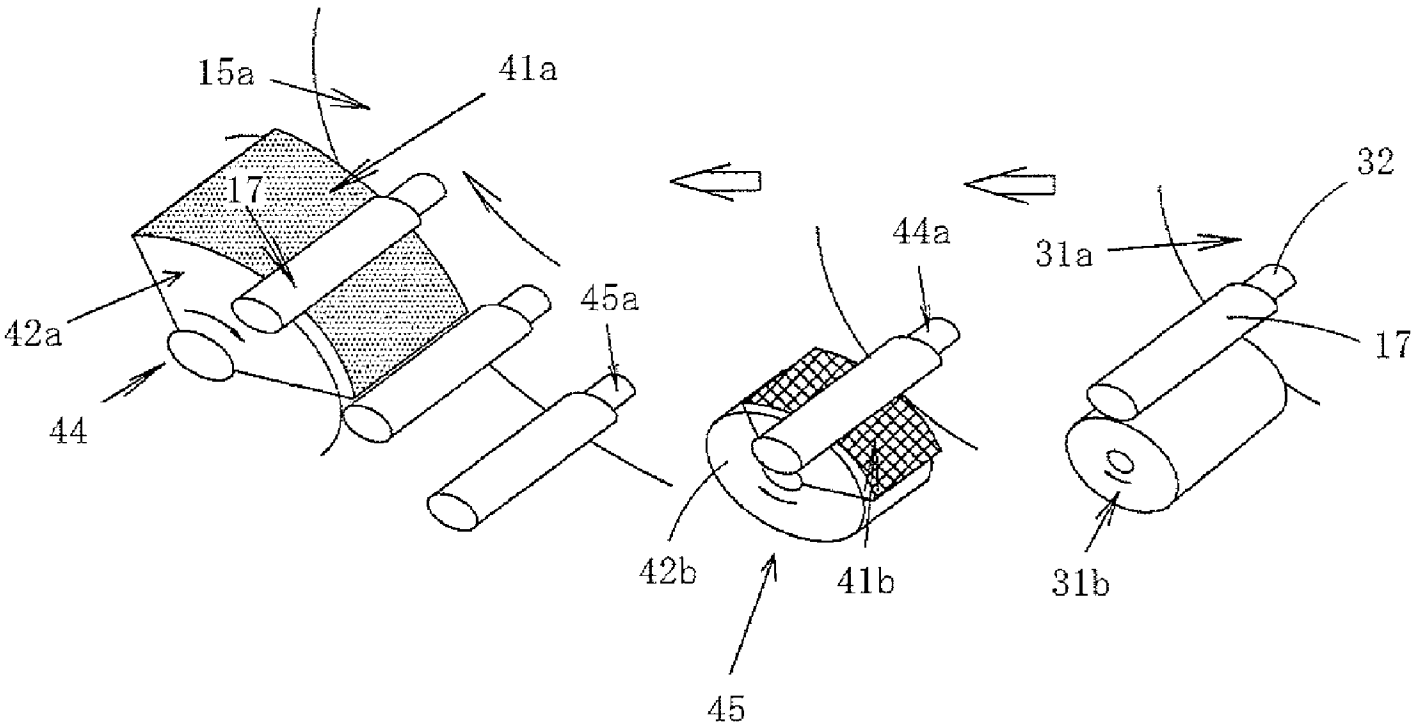
FIG. 19 is an outline drawing showing further the other embodiment of ornamenting method of this invention.

The ornamenting method of FIG. 19 is a method in which underprinting is performed on the surface of a container, then embossing is performed, and outer surface printing is performed at the last step. In this case, the arrangement of the embossing-drum 45 and the underprinting roller 52 is interchanged. Containers held at the mandrels of different turn tables are ornamented respectively by the underprinting roller 52, the embossing-drum, and the printing-drum 44. In this case also, it is preferable that prior to the process of the printing drum 44, the position alignment means of the container is provided.

Figure 20:
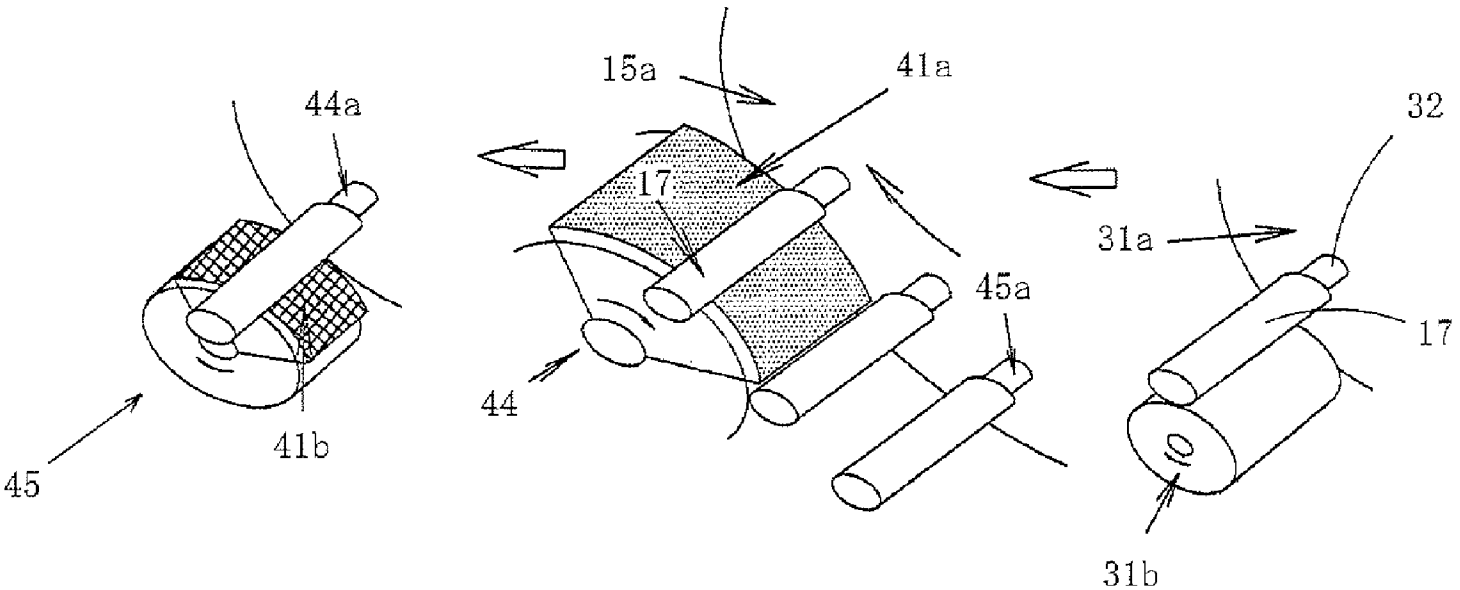
FIG. 20 is an outline drawing showing further the other embodiment of ornamenting method of this invention.

The ornamenting method of FIG. 20 is a method in which underprinting is performed on the surface of a container, then outer surface printing is performed, and embossing is performed at the last step. In this embodiment, containers held at the mandrels of different turn tables are ornamented respectively by the underprinting roller 52, the printing-drum 44, and the embossing-drum 45. In this case, it is preferable that the position alignment means of the container is provided prior to the process of the embossing-drum 45.

This invention is widely applicable to aerosol containers, tube containers, full-open DI cans, or bottle containers etc., and as the content, medical supplies, cosmetics, foods, drinks etc can be widely filled in, allowing a wide range of use.

The invention claimed is:

1. A process for manufacturing a decorated vessel by decorating a surface of a vessel performed on a manufacturing line of an outer surface printing process which holds the vessel with a holder, performing an outer surfacing printing process and an embossing process simultaneously or successively by depressing a drum to the surface of the vessel held by the holder, the drum having a blanket barrel and a blanket, the blanket arranged to rotate around an outer perimeter of the blanket barrel in a rotation direction, the blanket having an embossing-blanket having an embossing plate arranged in a perimeter of the blanket barrel, and a printing-blanket arranged at a perimeter of the blanket barrel, rotating the drum such that the embossing plate of the embossing-blanket embosses a design on a first surface the vessel, and the printing-blanket of the blanket transfers a design to a second surface of the vessel, and wherein the holder is a mandrel (12) inserted into the vessel (17), and a first periphery portion (23*a*) of the mandrel (12) corresponding to the first surface of the vessel (17) to be printed by the outer surface printing process is composed of a hard material, and a second periphery portion (23*b*) of the mandrel (12) corresponding to the second surface of the vessel (17) to be embossed by the embossing process is composed of a soft material.

2. A process for manufacturing a decorated vessel according to claim 1, wherein the step of rotating the drum causes the printing of the design on the vessel by the printing-blanket provided on an upper position of a rotation direction to occur after the embossing of the design by the embossing-blanket provided on an lower position of the rotation direction.

3. A process for manufacturing a decorated vessel according to claim 1, wherein the step of rotating the drum causes the printing of the design on the vessel by the printing-blanket provided on an lower position of a rotation direction occurs before the embossing of the design by the embossing-blanket provided on an upper position of the rotation direction.

4. A process for manufacturing a decorated vessel according to claim 1, wherein the embossing is performed by the embossing-blanket is fitted in a part of the printing-blanket that is cut out.

5. A process for manufacturing a decorated vessel according to claim 1, wherein the decorated vessel is an aerosol container, a tube container, a full-open type DI can, or a bottle container.

6. A decorating apparatus (10), comprising;

a mandrel which holds a vessel, and a drum having a blanket barrel, an embossing-blanket having an embossing plate arranged in a perimeter of the blanket barrel, and a printing-blanket arranged in a perimeter of the blanket barrel, and wherein the mandrel (12) has a first periphery portion (23*a*) corresponding to the first surface of the vessel (17) to be printed by the outer surface printing process is composed of a hard material, and a second periphery portion (23*b*) of the mandrel (12) corresponding to the second surface of the vessel (17) to be embossed by the embossing process is composed of a soft material.

7. A process for manufacturing a decorated vessel according to claim 1, wherein the printing-blanket (14*a*, 24*a*, 26*a*) is provided on an upper position of a rotation direction and the embossing-blanket (14*b*, 24*b*, 26*b*) is provided on an lower position of the rotation direction.

8. A process for manufacturing a decorated vessel according to claim 1, wherein the printing-blanket is provided on an lower position of a rotation direction and the embossing-blanket is provided on an upper position of the rotation direction.

9. A process for manufacturing a decorated vessel according to claim 1, wherein a part of the printing-blanket (27*a*) is cut out, and the embossing-blanket (27*b*) is fitted in the printing-blanket (27*a*).

* * * * *